US008430068B2

(12) United States Patent
Harris et al.

(10) Patent No.: US 8,430,068 B2
(45) Date of Patent: Apr. 30, 2013

(54) COOLING SYSTEM HAVING INLET CONTROL AND OUTLET REGULATION

(76) Inventors: James Wallace Harris, Galveston, IN (US); Michael Patrick Ramm, Peoria, IL (US); Jeffery Lynn Prewett, Metamora, IL (US)

( * ) Notice: Subject to any disclaimer, the term of this patent is extended or adjusted under 35 U.S.C. 154(b) by 100 days.

(21) Appl. No.: 11/806,376

(22) Filed: May 31, 2007

(65) Prior Publication Data

US 2008/0295785 A1 Dec. 4, 2008

(51) Int. Cl.
*F01P 7/14* (2006.01)

(52) U.S. Cl.
USPC ..... 123/41.1

(58) Field of Classification Search ..... 123/41.08, 123/41.29, 41.02, 41.01, 41.05, 41.1, 41.09, 123/41.3, 41.51, 563, 41.31, 599; 60/599
See application file for complete search history.

(56) References Cited

U.S. PATENT DOCUMENTS

| | | | | |
|---|---|---|---|---|
| 3,134,371 | A * | 5/1964 | Crooks | 123/41.31 |
| 4,332,221 | A | 6/1982 | Imhof et al. | |
| 4,697,551 | A * | 10/1987 | Larsen et al. | 123/41.31 |
| 4,942,849 | A | 7/1990 | Shelton | |
| 5,201,285 | A * | 4/1993 | McTaggart | 123/41.31 |
| 5,215,044 | A * | 6/1993 | Banzhaf et al. | 123/41.29 |
| 5,415,147 | A * | 5/1995 | Nagle et al. | 123/563 |
| 5,505,165 | A * | 4/1996 | Kimoto | 123/41.12 |
| 5,598,705 | A * | 2/1997 | Uzkan | 60/599 |
| 5,975,031 | A | 11/1999 | Bartolazzi | |
| 6,006,731 | A * | 12/1999 | Uzkan | 123/563 |
| 6,390,031 | B1 | 5/2002 | Suzuki et al. | |
| 6,499,298 | B2 * | 12/2002 | Uzkan | 60/599 |
| 6,520,125 | B2 | 2/2003 | Suzuki et al. | |
| 6,530,347 | B2 | 3/2003 | Takahashi et al. | |
| 6,662,761 | B1 * | 12/2003 | Melchior | 123/41.44 |
| 6,837,193 | B2 | 1/2005 | Kobayashi et al. | |
| 6,848,397 | B2 | 2/2005 | Haase | |
| 6,904,875 | B2 | 6/2005 | Kilger | |
| 6,997,143 | B2 | 2/2006 | Piccirilli et al. | |
| 7,070,118 | B2 * | 7/2006 | Kawasaki et al. | 236/101 C |
| 7,090,940 | B2 * | 8/2006 | Schrooten et al. | 429/429 |
| 7,182,048 | B2 | 2/2007 | Nakano | |
| 7,258,083 | B2 * | 8/2007 | Lindsey | 123/41.08 |
| 7,267,084 | B2 * | 9/2007 | Lutze et al. | 123/41.02 |
| 7,444,962 | B2 * | 11/2008 | Engelin et al. | 123/41.1 |

(Continued)

FOREIGN PATENT DOCUMENTS

| | | |
|---|---|---|
| DE | 2523436 | 12/1976 |
| DE | 19943981 | 3/2001 |
| JP | 57176317 | 10/1982 |

*Primary Examiner* — Stephen K Cronin
*Assistant Examiner* — Sizo Vilakazi
(74) *Attorney, Agent, or Firm* — Miller, Matthias & Hull

(57) ABSTRACT

A cooling system is disclosed. The cooling system may have a heat source, a heat exchanger, and a coolant pump located between the heat exchanger and the heat source to direct coolant from the heat exchanger to the heat source. The cooling system may also have a valve located between the heat source and the heat exchanger. The valve may be movable to vary a rate of coolant flow through the heat exchanger and around the heat exchanger to the coolant pump. The cooling system may further have a sensor located at an inlet of the heat source to generate a signal indicative of coolant temperature at the inlet, and a controller in communication with the valve and the sensor. The controller may be configured to move the valve based on the temperature of the coolant at only the inlet of the heat source.

13 Claims, 2 Drawing Sheets

U.S. PATENT DOCUMENTS

| | | | | |
|---|---|---|---|---|
| 7,735,461 | B2 * | 6/2010 | Vetrovec | 123/41.14 |
| 2003/0089319 | A1 * | 5/2003 | Duvinage et al. | 123/41.02 |
| 2004/0144340 | A1 * | 7/2004 | Kilger | 123/41.1 |
| 2004/0237911 | A1 * | 12/2004 | Sano | 123/41.1 |
| 2005/0028756 | A1 | 2/2005 | Santanam et al. | |
| 2006/0005790 | A1 * | 1/2006 | Braun et al. | 123/41.08 |
| 2006/0185364 | A1 | 8/2006 | Chalgren et al. | |
| 2006/0185626 | A1 | 8/2006 | Allen et al. | |
| 2006/0200283 | A1 * | 9/2006 | Furuno et al. | 701/29 |
| 2008/0216777 | A1 * | 9/2008 | Vetrovec | 123/41.29 |

* cited by examiner

COOLING SYSTEM HAVING INLET CONTROL AND OUTLET REGULATION

TECHNICAL FIELD

The present disclosure relates generally to a cooling system and, more particularly, to a cooling system that regulates a coolant outlet flow from a heat producing device based on a coolant inlet temperature of the heat producing device.

BACKGROUND

Engines, including diesel engines, gasoline engines, and gaseous fuel-powered engines are used to generate a mechanical, hydraulic, or electrical power output. In order to accomplish this power generation, an engine typically combusts a fuel/air mixture. This combustion process generates large amounts of heat and, in order to ensure proper and efficient operation of the engine, a cooling system is required to cool fluids directed into or out of the engine.

An internal combustion engine is generally fluidly connected to several different liquid-to-air and/or air-to air heat exchangers to cool both liquids and gases circulated throughout the engine. These heat exchangers are often located close together and/or close to the engine to conserve space on the machine. An engine-driven fan is disposed either in front of the engine/exchanger package to blow air across the exchangers and the engine, or between the exchangers and the engine to draw air past the exchangers and blow air past the engine.

The size of the engine, power output of the engine, and/or exhaust emissions from the engine may be at least partially dependent on the amount of cooling provided to the engine. That is, the engine may have a maximum temperature and a most efficient operating temperature range, and operation of the engine may be limited by the ability of the associated exchangers to maintain the engine's temperatures below the maximum limit and within the optimum range.

One way to maintain the engine's temperatures within an optimal range is disclosed in U.S. Pat. No. 6,904,875 (the '875 patent) issued to Kilter on Jun. 14, 2005. The '875 patent describes a coolant circuit of an internal combustion engine. The coolant circuit includes a coolant pump, coolant temperature sensors, and a bypass valve that routes coolant flow from the internal combustion engine, depending on its position, through a radiator or passing the radiator to the coolant pump. The bypass valve is electronically controlled to route a greater or lesser coolant flow through the radiator in response to signals from the temperature sensors such that an optimal range of engine temperatures is maintained. That is, in control of the coolant temperature within the circuit, the position of the bypass valve is regulated as a function of the coolant temperature at the outlet of the internal combustion engine and by the difference between the coolant temperatures at the outlet and the inlet of the internal combustion engine.

Although the coolant circuit of the '875 patent may help to maintain desired coolant temperatures, it may be complex and limited. Specifically, the coolant circuit utilizes multiple temperatures sensors and requires complex calculations to control the bypass valve. The multiple sensors increase hardware cost and complexity, while the multiple inputs and calculations increases control difficulty. Further, because control of the bypass valve is based primarily on engine outlet temperature, the inlet temperature experienced by the engine and having the greatest effect on engine operation may be insufficiently controlled. Further, the coolant circuit of the '875 patent may be inapplicable to an engine system having dual coolant circuits interrelated by way of primary and secondary aftercoolers.

The disclosed cooling system is directed to overcoming one or more of the problems set forth above.

SUMMARY OF THE INVENTION

In one aspect, the present disclosure is directed to a cooling system. The cooling system may include a heat source, a heat exchanger, and a coolant pump located between the heat exchanger and the heat source to direct coolant from the heat exchanger to the heat source. The cooling system may also include a valve located between the heat source and the heat exchanger. The valve may be movable to vary a rate of coolant flow through the heat exchanger and around the heat exchanger to the coolant pump. The cooling system may further include a sensor located at an inlet of the heat source to generate a signal indicative of coolant temperature at the fluid inlet, and a controller in communication with the valve and the sensor. The controller may be configured to move the valve based on the temperature of the coolant at only the inlet of the heat source.

In another aspect, the present disclosure is directed to a method of cooling a heat source. The method may include generating a flow of coolant, and directing the flow of coolant to the heat source. The method may also include determining a temperature of the coolant at an entrance of the heat source, and directing the flow of coolant from the heat source. The method may further include selectively cooling a portion of the coolant from the heat source, wherein the amount of selective cooling is based on the temperature of the coolant at only the entrance of the heat source.

DETAILED DESCRIPTION

Figure 1:
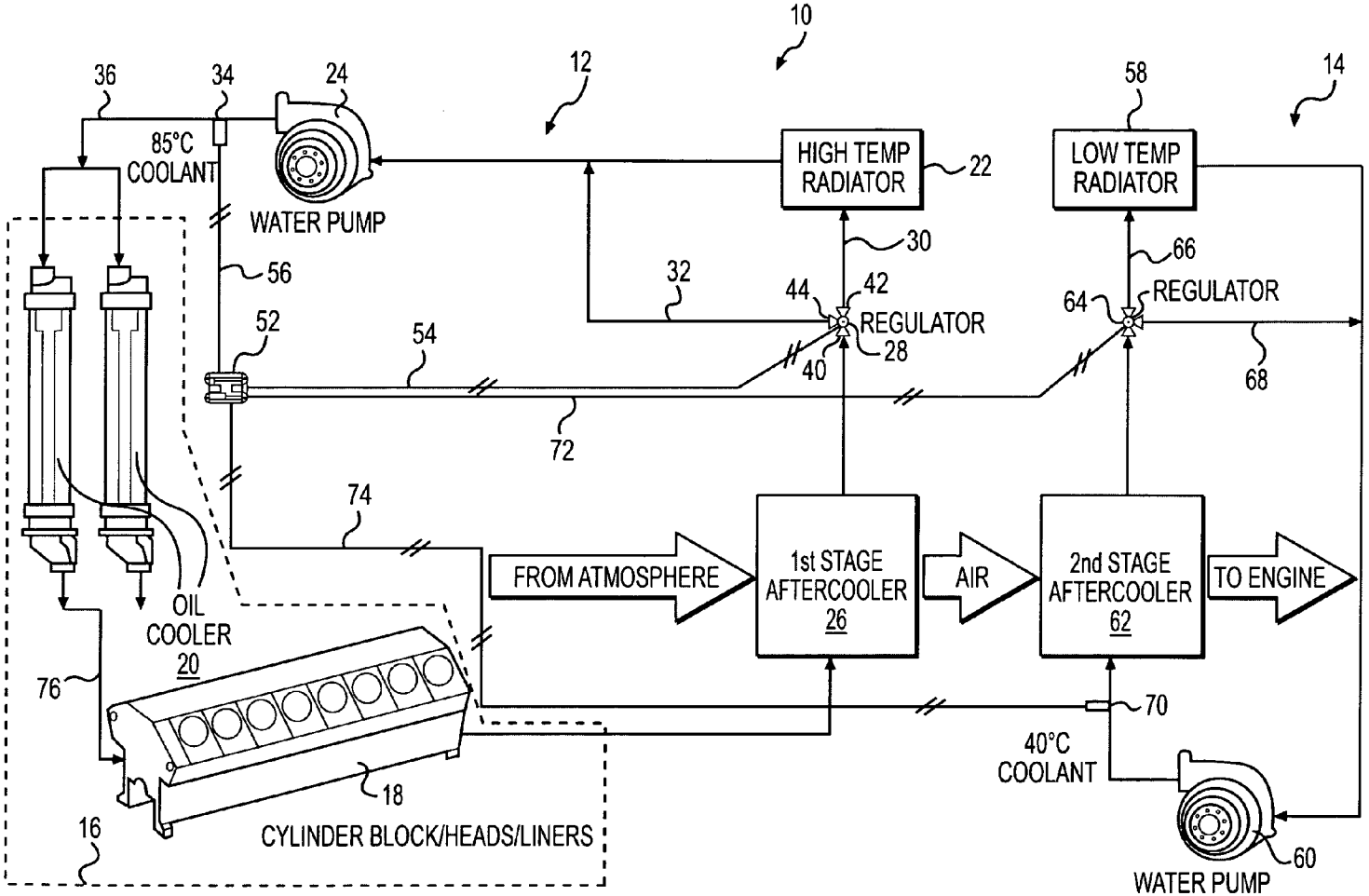
FIG. 1 is a pictorial and schematic illustration of an exemplary disclosed cooling system.

FIG. 1 illustrates a cooling system 10. Cooling system 10 may include a high temperature circuit 12 and a low temperature circuit 14. High temperature circuit 12 may regulate coolant flow from a heat source 16 based on a coolant inlet temperature of the heat source 16. Low temperature circuit 14 may regulate coolant flow from an aftercooler 62 based on a coolant inlet temperature of the aftercooler 62.

Heat source 16 may embody an engine having multiple components that cooperate to combust a fuel/air mixture and produce a power output. For example, heat source 16 may be a diesel engine, a gasoline engine, or a gaseous fuel-powered engine having an engine block 18 that defines a plurality of cylinders, a piston (not shown) slidably disposed within each cylinder, and a cylinder head associated with each cylinder. Heat source 16 may draw the fuel/air mixture into each cylinder, compress the mixture with the piston, and ignite the mixture to produce a combination of power, heat, and exhaust.

Heat source 16 may further include an oil cooler 20 located upstream of the engine block 18. Oil cooler 20 may be situated to cool engine oil directed through heat source 16 for lubrication and/or cooling purposes. Oil cooler 20 may be any type of liquid-to-liquid heat exchanger such as, for example, a flat plate type heat exchanger, or a tube and bundle-type heat exchanger. Oil cooler 20 may be fluidly connected to engine block 18 by way of a passage 76.

High temperature circuit 12 may include a heat exchanger 22, a coolant pump 24, an aftercooler 26, and a valve 28. Coolant pump 24 may be located between heat exchanger 22 and heat source 16 to direct coolant from heat exchanger 22 to heat source 16. Aftercooler 26 may be located between heat source 16 and heat exchanger 22 to reduce the temperature of ambient air before it enters heat source 16. Valve 28 may be located between aftercooler 26 and heat exchanger 22. Valve 28 may be movable to vary a rate of fluid flow through the heat exchanger 22 by way of a coolant line 30, and around the heat exchanger 22 to the coolant pump 24 by way of a bypass line 32. A sensor 34 may be located at a fluid inlet of the heat source 16 to generate a signal indicative of the coolant temperature entering heat source 16.

Heat exchanger 22 may embody the main radiator (i.e., high temperature radiator) of heat source 16 and be situated to dissipate heat from a coolant after it has circulated throughout heat source 16. The coolant may include water, glycol, a water/glycol mixture, or a blended air mixture. The heat exchanger 22 may be a liquid-to-air heat exchanger, and cooling system 10 may include a fan located proximal to heat exchanger 22 to generate a flow of air across the heat exchanger 22 to absorb heat from the coolant.

Coolant pump 24 may be located upstream of heat source 16 to generate a flow of coolant directed to heat source 16. Coolant pump 24 may be engine driven to generate a flow of coolant through the high temperature circuit 12. Coolant pump 24 may include an impeller (not shown) disposed within a volute housing having an inlet and an outlet. As the coolant enters the volute housing, blades of the impeller may be rotated by operation of heat source 16 to push against the coolant, thereby pressurizing the coolant. An input imparted by heat source 16 to coolant pump 24 may be related to a pressure of the coolant, while a speed imparted to coolant pump 24 may be related to a flow rate of the coolant. It is contemplated that coolant pump 24 may alternatively embody a piston type pump, if desired, and may have a variable or constant displacement. Coolant pump 24 may be fluidly connected to oil cooler 20 along an inlet coolant line 36 and configured to cause the coolant within the high temperature circuit 12 to flow. It is contemplated that coolant pump 24 may be electrically driven, mechanically driven, or driven in any other manner known in the art.

Aftercooler 26 may be a first stage aftercooler in a multi-circuit cooling system. Aftercooler 26 may be located upstream of heat source 16 and may serve to cool ambient air from the atmosphere before it enters heat source 16. Aftercooler 26 may be a liquid-to-air heat exchanger. That is, the flow of intake air may be directed through channels of aftercooler 26 such that heat from the intake air is transferred to coolant (or from the coolant to the air, in extreme cold conditions) exiting heat source 16 in adjacent channels before the intake air enters heat source 16. In this manner, the air entering heat source 16 may be cooled to below (or heated to above) a predetermined operating temperature of heat source 16.

Figure 2:
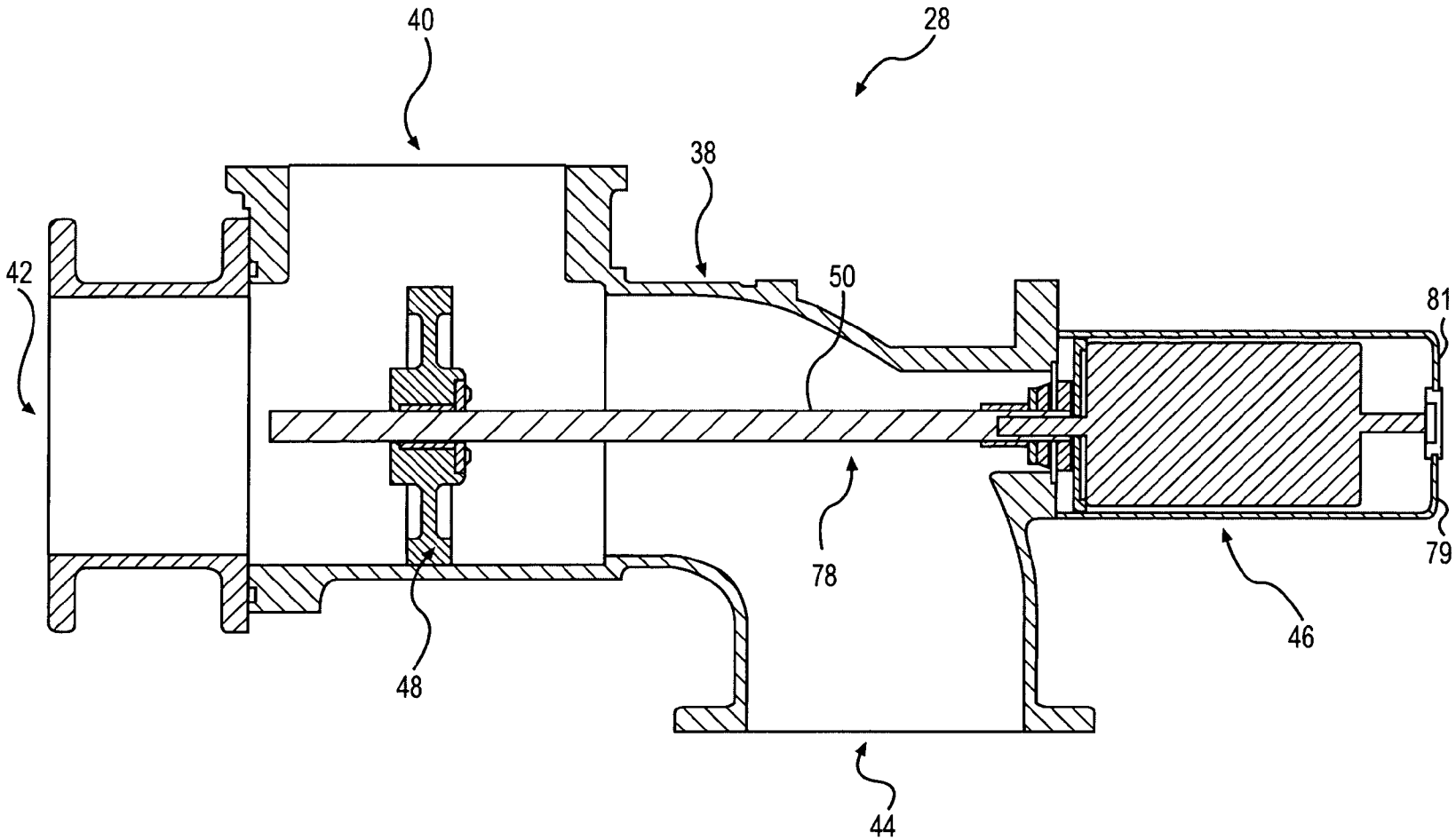
FIG. 2 is a cross-sectional illustration of an exemplary disclosed regulator valve of FIG. 1.

Valve 28 (as shown in FIG. 2) may embody a three-way regulator valve and may be electronically actuated. Valve 28 may include a valve body 38, an input port 40, a heat exchanger port 42, and bypass port 44. Valve 28 may further include a valve mechanism 78 for varying an amount of fluid flow from the input port 40 to heat exchanger port 42 and bypass port 44. Valve mechanism 78 may comprise a motor 46, a piston 48, and a shaft 50 connecting motor 46 to piston 48. Motor 46 may direct rotary movement through shaft 50 to cause linear movement of piston 48. Motor 46 may be a stepper motor or any other type of motor capable of affecting movement of piston 48 to thereby vary fluid flow through heat exchanger port 42 and bypass port 44. Motor 46 may move piston 48 toward heat exchanger port 42 and away from bypass port 44 to cause more fluid to flow through bypass port 44, thereby increasing the amount of fluid flow that bypasses heat exchanger 22. Alternatively, motor 46 may move piston 48 toward bypass port 44 and away from heat exchanger port 42 to cause more fluid to flow through heat exchanger port 42, thereby increasing the amount of fluid flow that passes through heat exchanger 22.

It is contemplated that valve mechanism 78 of valve 28 may be moved manually by an operator in order to maintain control during an electrical failure of motor 46. For example, an operator may remove a cover 79 to gain access to an end 81 of motor 46 or shaft 50 and thereby move valve mechanism 78 by manually rotating shaft 50 with a hand tool (not shown) or by any other known method capable of imparting movement of piston 48.

Sensor 34 (referring back to FIG. 1) may be a temperature sensor and may be mounted downstream of coolant pump 24 and upstream of oil cooler 20 to measure coolant temperature at an inlet of heat source 16. It is contemplated that sensor 34 may be any type of sensor capable of indicating coolant temperature. Sensor 34 may generate a signal indicative of the coolant temperature, and send this signal to a controller 52.

Controller 52 may be in communication with valve 28 and sensor 34. In particular, controller 52 may command valve 28 to vary fluid flow through heat exchanger port 42 and bypass port 44 in an amount related to a coolant temperature, as monitored by sensor 34. Controller 52 may be in communication with valve 28 and sensor 34 by communication lines 54 and 56, respectively. It is contemplated that a separate controller (not shown) may be used to control heat source 16. Controller 52 and the controller used to control heat source 16 may be either the same controller or may be separate controllers. It may be advantageous to utilize controller 52 as a separate controller in order to reduce the amount of memory required by each controller.

Low temperature circuit 14 may be separate from high temperature circuit 12 and, thereby, provide additional aftercooling for heat source 16. Low temperature circuit 14 may include a heat exchanger 58, a coolant pump 60, an aftercooler 62, and a valve 64. Aftercooler 62 may be located between heat exchanger 58 and coolant pump 60, and may serve as a second stage aftercooler in a multi-circuit cooling system. Valve 64 may be located between aftercooler 62 and heat exchanger 58. Valve 64 may be movable to vary a rate of fluid flow through heat exchanger 58 by way of a coolant line 66, and around the heat exchanger 58 to the coolant pump 60 by way of a bypass line 68. It is contemplated that valve 64 may be generally the same type as valve 28 (as shown in FIG. 2). Alternatively, valves 28 and 64 may be different in type, as long as each valve allows varied fluid flow to and around heat exchangers 22 and 58, respectively. A sensor 70 may be located at a fluid inlet of aftercooler 62 to generate a signal indicative of coolant temperature at the inlet of aftercooler 62.

Controller 52 may command valve 64, similarly to valve 28, to vary fluid flow through the heat exchanger port 42 and bypass port 44 in an amount related to a coolant temperature, as monitored by sensor 70. Controller 52 may be in communication with valve 64 and sensor 70 by communication lines 72 and 74, respectively.

INDUSTRIAL APPLICABILITY

The disclosed cooling system may be used in any machine or power system application that requires precise control over operating temperatures. In particular, the disclosed system may provide a simple and accurate way to control temperatures that heat source components experience by measuring coolant temperature at an inlet of the heat source and regulating coolant flow at an outlet of the heat source. The operation of cooling system 10 will now be described.

During operation of cooling system 10, coolant fluid may flow through high temperature circuit 12. As coolant pump 24 discharges coolant, coolant temperature may be measured by sensor 34 at an inlet of heat source 16. The coolant may then pass through oil cooler 20 and engine block 18 to cool the heat source 16. After passing through the heat source 16, the coolant may continue through aftercooler 26 and valve 28 to heat exchanger 22. Based on the measured coolant temperature at the inlet of heat source 16, controller 52 may signal movement of valve 28 to vary the fluid flow through or around heat exchanger 22. In particular, the coolant from downstream of heat source 16 may either flow through heat exchanger 22 or around the heat exchanger 22 to regulate a temperature of the coolant entering the heat source 16. For example, if a desired coolant temperature is 85 degrees and the measured coolant temperature is 100 degrees, valve mechanism 78 will move piston 48 toward bypass port 44 to permit a greater amount of coolant to flow through heat exchanger port 42 and to be cooled by heat exchanger 22 via coolant line 30. In contrast, if a desired temperature is 85 degrees and the measured coolant temperature is 75 degrees, valve mechanism 78 will move piston 48 toward heat exchanger port 42 to permit a greater amount of coolant to flow through bypass port 44 and around heat exchanger 22. Heat source 16 may be cooled when a greater amount of coolant is allowed to pass through heat exchanger 22 in response to the measured coolant temperature being greater than the desired coolant temperature. Likewise, heat source 16 may be warmed when less coolant is allowed to pass through heat exchanger 22 in response to the measured coolant temperature being less than the desired coolant temperature.

It is contemplated that, during operation of cooling system 10, coolant may also flow through a separate low temperature circuit 14. As coolant pump 60 discharges coolant, coolant temperature may be measured by sensor 70 at an inlet of aftercooler 62. Then, at a position downstream of aftercooler 62, the coolant may either be directed through or around heat exchanger 58 by way of valve 64 in response to the measured coolant temperature. It may be desirable to have multi-circuit air-to-air inlet cooling in order to achieve several advantages over a single circuit system. First, a multi-circuit or multi-stage cooling system may allow for compounded cooling (i.e., increase cooling over that provided by a single aftercooler). Second, a multi-circuit system may allow a design that reduces extreme temperature differences experienced by a single circuit aftercooler. Third, a multi-circuit system may allow temperatures to be averaged between multiple coolers, wherein one circuit may be cooling and another circuit warming to achieve an averaged temperature.

Since valves 28, 64 may be electronically controlled, various control strategies may be employed. Specifically, heat source 16 may have different modes of operation, including a start-up mode, a regulated mode, and a shutdown mode. It is contemplated that at least some coolant may always pass through the heat exchangers 22, 58, regardless of the particular operating mode.

In the start-up mode, the valves 28, 64 may both remain substantially closed and pass a majority of the coolant fluid around heat exchangers 22, 58 until the heat source 16 has achieved a predetermined temperature, as may be measured by coolant sensors 34, 70. Since heat source 16 may be relatively cool at start-up, it may be desirable to pass a majority of the coolant around the heat exchangers 22, 58 via bypass lines 32, 68 because cooling heat source 16 may be unnecessary until heat source 16 warms to the predetermined temperature, thereby increasing the efficiency of the cooling system 10. While in the start-up mode, valves 28, 64 may remain at least partially open so that, upon the heat source 16 reaching warm temperatures, a sudden slug of hot coolant may not be experienced by aftercooler 26 or a slug of cold coolant may not suddenly be experienced by heat source 16. By minimizing sudden and extreme temperature differentials, the likelihood of damage to aftercooler 62, heat source 16, or any other system component, may be reduced.

More specifically regarding high temperature circuit 12, the coolant temperature may be determined at start-up by allowing some flow of coolant through heat source 16 after a predetermined amount of time, and measuring the temperature thereof. It is contemplated that, if a predetermined temperature can be maintained through the high temperature circuit 12, then control may move from the start-up mode to the regulated mode. More specifically, temperatures may be considered maintained when they fail to deviate from a predetermined range of temperatures.

When the coolant temperature can be maintained within a predetermined temperature range, more coolant may be allowed to pass through heat exchangers 22, 58. For the high temperature circuit 12, it is contemplated that the predetermined temperature range may be between about 80-90 degrees Celsius, but other settings may be appropriate to trigger a change from the start-up mode to the regulated mode based on the characteristics of the heat source 16. Therefore, when a predetermined temperature range of about 80-90 degrees Celsius is desired and a measured temperature of, for example, 70 degrees is detected by sensor 34, controller 52 may signal valve 28 to pass more coolant around heat exchanger 22 to raise the coolant temperature into the desired range. Likewise, when a measured temperature of, for example, 100 degrees is detected by sensor 34, controller 52 may signal valve 28 to pass more coolant though heat exchanger 22 to lower the coolant temperature into the desired range. If the measured coolant temperature is, for example, 85 degrees, as detected by sensor 34, controller 52 may signal valve 28 to pass a sufficient amount of coolant through heat exchanger 22 to maintain the coolant temperature in the predetermined coolant range.

It is contemplated that the predetermined temperature range for low temperature circuit 14 may be between about 35-45 degrees Celsius, but other setting may be appropriate to trigger a change from the start-up mode to the regulated mode based on the characteristics of the heat source 16. Low temperature circuit 14 may operate in a manner similar to high temperature circuit 12 to thereby pass more coolant through heat exchanger 58 when measured coolant temperature is above the predetermined temperature range of about 35-45 degrees Celsius, and may pass less coolant through heat exchanger 58 when a measured coolant temperature is below the predetermined temperature range of about 35-45 degrees Celsius. When the measured coolant temperature is within the predetermined temperature range of about 35-45 degrees Celsius, low temperature circuit 14 may pass a sufficient amount of coolant through heat exchanger 58 to maintain the measured coolant temperature within the predetermined temperature range.

Once the measured coolant temperature can be maintained within the predetermined temperature range of the respective cooling circuit, control may move from the start-up mode to the regulated mode. While in the regulated mode, controller 52 may receive measured coolant temperatures from sensors 34, 70 at the inlet of the heat source 16 and aftercooler 62, respectively. Controller 52 may control valves 28, 64 to move in a manner that passes a sufficient amount of coolant through heat exchangers 22, 58 to maintain the measured coolant temperatures within the predetermined temperature ranges. Therefore, if for example, the measured coolant temperature (i.e., 75 degrees Celsius) drops below the predetermined temperature range of about 80-90 degrees for the high temperature circuit 12, controller 52 may signal valve 28 to allow more coolant to bypass heat exchanger 22 and thereby warm the coolant to a temperature within the predetermined temperature range. The regulated mode may continue until indication of the shutdown of heat source 16 and, thereby, move control from the regulated mode to the shutdown mode.

The shutdown mode may be tailored to meet a number of different conditions and may be triggered in response to the heat source 16 being turned off. It is contemplated that there may be multiple shutdown modes corresponding to a desire to maintain the temperature of heat source 16, and a desire to quickly cool down heat source 16. A delayed cool down mode may reduce the amount of coolant passing through the heat exchangers 22, 58, and thus, may slow the heat rejection rate of heat exchangers 22, 58. In contrast, a rapid cool down mode may increase the amount of coolant fluid passing through the heat exchangers 22, 58, and, thus, may increase the heat rejection rate of heat exchangers 22, 58. The delayed and rapid cool down modes may be operator selectable.

If restart of heat source 16 is desired within a relatively short period of time, for example 2-3 hours, the delayed cool down mode may be implemented and valve 28 may be closed almost completely, so that cooling of heat source 16 occurs very slowly. In the delayed cool down mode, the controller 52 may move valve 28 to pass a majority of coolant around heat exchanger 22 to the coolant pump 24 via bypass line 32. Likewise, in the delayed cool down mode, controller 52 may move valve 64 to pass a majority of the coolant around the heat exchanger 58 to the coolant pump 60 via bypass line 68.

In contrast, it may be desired to have the heat source 16 cool down rapidly, for example, if service on heat source 16 will be performed soon after shutdown. Thus, valve 28 may open nearly all the way in the rapid cool down mode, allowing most of the coolant to be circulated through heat source 16. In the rapid cool down mode controller 52 may move valve 28 to pass a majority of the coolant through heat exchanger 22 via coolant line 30. Likewise, in the rapid cool down mode, controller 52 may move the valve 64 to pass a majority of the coolant through the heat exchanger 58 via coolant line 66.

Because valves 28, 64 may be electronically controlled, predetermined temperature set points that control movement of valves 28, 64 may be electronically changed by an operator at any time to any temperature range that meets the needs of various applications. That is, the temperature at which modes switch from start-up to regulated may be changed from a range of about 80-90 degrees Celsius to a lower or higher range, and the corresponding valve opening amount may likewise be modified.

Valves 28, 64 may need periodic resetting. That is, valves 28, 64 may move in a range that is smaller than a full possible range of movement and, after a period of time, valves 28, 64 may become stuck in the smaller range and may require periodic movement throughout their entire range of motion to reset the respective valve. In addition, if during operation, valves 28, 64 are determined to be at an end of their range of motion and a desired coolant temperature has not yet been achieved, it may be possible that the motion of the valves 28, 64 has been lost or accuracy of the position measurement may have been lost. In this situation, the respective valve may be energized to move past its normal range of motion to see if any effect on the temperature is achieved. For example, a valve may be showing that it is at the end of its range, when it is really short of the end by an amount. In this situation, the valve may be urged further toward its range end and, if the valve is already at its range end, no change will be observed. If the valve is urged further toward its range end and if the valve is not already at its range end, then the valve will be reset to allow for additional movement, thereby, permitting additional effect on coolant temperature. Further, it may be advantageous to purge air from the valves 28, 64, for example, at the start-up of the system.

If valves 28, 64 fail to move due to an electrical failure of motor 46, an operator may manually control movement of the valves 28, 64. That is, even if motor 46 fails, a tool, for example a wrench, may be manually applied to valves 28, 64 and turned to impart movement of valves 28, 64 and vary coolant fluid through or around heat exchangers 22, 58.

Cooling system 10 may operate as a multi-circuit cooling system by using high temperature circuit 12 and low temperature circuit 14. During operation of high temperature circuit 12, aftercooler 26 may serve as a first stage aftercooler to cool ambient air from the atmosphere before it enters the heat source 16. It is contemplated that aftercooler 62, within low temperature circuit 14, may serve as a second stage aftercooler to further cool the air that was cooled by first stage aftercooler 26 before it enters the heat source 16.

Cooling system 10 may regulate a coolant outflow from heat source 16 based on a coolant inlet temperature of the heat source 16. Regulating coolant temperature based on the measured temperature of coolant at an inlet of heat source 16 may permit more accurate measurement of the conditions experienced by heat source 16. For example, engine bearings (not shown) may be critical to the operation of the heat source 16, and locating oil cooler 20 just upstream of the engine block 18 may allow the engine bearings to be efficiently lubricated and cooled by oil cooler 20. Therefore, it may be advantageous to sense coolant temperature at an inlet to oil cooler 20 to more accurately measure the conditions experienced by the engine bearings and other heat source components as compared to sensing coolant temperature further upstream relative to the heat source 16 where the coolant temperature may change as the coolant flows downstream to the heat source 16.

It will be apparent to those skilled in the art that various modifications and variations can be made to the disclosed cooling system without departing from the scope of the disclosure. Other embodiments of the cooling system will be apparent to those skilled in the art from consideration of the specification and practice of the cooling system disclosed herein. It is intended that the specification and examples be considered as exemplary only, with a true scope of the disclosure being indicated by the following claims and their equivalents.

What is claimed is:

1. A cooling system, comprising:

a heat source;

a heat exchanger;

a coolant pump located between the heat exchanger and the heat source to direct coolant from the heat exchanger to the heat source;

a valve located between the heat source and the heat exchanger, the valve being movable to vary a rate of coolant flow through the heat exchanger and around the heat exchanger to the coolant pump;

a sensor located at an inlet of the heat source to generate a signal indicative of coolant temperature at the inlet;

a memory storing software adapted to execute a plurality of different operating modes, wherein a predetermined start-up mode temperature and a predetermined regulated mode temperature range are stored in the memory, with the predetermined start-up mode temperature being less than a lower limit of the predetermined regulated mode temperature range; and a controller in communication with the valve, sensor and memory, the controller being configured to move the valve based on the temperature of the coolant at only the inlet of the heat source and the operating mode, wherein the plurality of different operating modes includes a start-up mode when the coolant temperature is less than the predetermined start-up mode temperature, in which the controller actuates the valve to a fixed, partially open position which causes a majority of the coolant to flow around the heat exchanger while some of the coolant flows through the heat exchanger for all coolant temperatures that are less than the predetermined start-up mode temperature, and a regulated mode when the coolant temperature is greater than the predetermined start-up mode temperature, in which the controller modulates a position of the valve to maintain the coolant temperature within the predetermined regulated mode temperature range;

wherein the controller is programmed to initially operate in the start-up mode when the coolant temperature is less than the predetermined start-up mode temperature; and wherein the controller is programmed to switch from the start-up mode to the regulated mode when the coolant temperature is greater than the predetermined start-up mode temperature.

2. The cooling system of claim 1, wherein the heat source is an internal combustion engine.

3. The cooling system of claim 2, wherein:

the internal combustion engine includes an oil cooler located upstream of an engine block; and the sensor is located at an inlet of the oil cooler.

4. The cooling system of claim 1, wherein the valve is electronically actuated.

5. The cooling system of claim 1, wherein the valve may be manually moved to control the coolant flow through the heat exchanger and around the heat exchanger in the event of electrical system failure.

6. The cooling system of claim 1, wherein at least some coolant is always passed through the heat exchanger.

7. The cooling system of claim 1, wherein the plurality of operating modes further includes a shutdown mode.

8. The cooling system of claim 7, wherein the shutdown mode includes a first shutdown mode corresponding with a delayed cool down of the heat source, and the controller is configured to move the valve to pass a majority of coolant around the heat exchanger to the coolant pump during the first shutdown mode.

9. The cooling system of claim 8, wherein the shutdown mode includes a second shutdown mode corresponding with a rapid cool down of the heat source, and the controller is configured to move the valve to pass a majority of coolant through the heat exchanger to the coolant pump during the shutdown mode.

10. The cooling system of claim 9, wherein the first and second shutdown modes are operator selectable.

11. A power unit, comprising:

an engine having an oil cooler fluidly connected upstream of an engine block;

a high temperature radiator;

a first stage aftercooler fluidly connected between the engine block and the high temperature radiator;

a first coolant pump located between the high temperature radiator and the oil cooler to direct coolant from the high temperature radiator to the oil cooler;

a first bypass valve located between the first stage aftercooler and the high temperature radiator, the first bypass valve being movable to vary a rate of coolant flow through the high temperature radiator and around the high temperature radiator to the first coolant pump;

a first sensor located at an inlet of the oil cooler to generate a signal indicative of coolant temperature at the inlet;

a controller in communication with the first bypass valve and the first sensor, the controller being configured to move the first bypass valve based on the temperature of the coolant at only the inlet of the oil cooler;

a second stage aftercooler fluidly connected to receive a flow of air from the first stage aftercooler;

a low temperature radiator connected to receive coolant from the second stage aftercooler;

a second coolant pump located between the low temperature radiator and the second stage aftercooler to direct coolant from the low temperature radiator to the second stage aftercooler;

a second bypass valve located between the second stage aftercooler and the low temperature radiator, the second bypass valve being movable to vary a rate of coolant flow through the low temperature radiator and around the low temperature radiator to the second coolant pump; and a second sensor located at an entrance of the second stage aftercooler;

wherein the controller is in further communication with the second bypass valve and the second sensor, the controller being configured to move the second bypass valve based on the temperature of the coolant at only the inlet of the second stage aftercooler.

12. A cooling system, comprising:

a heat source;

a heat exchanger;

a coolant pump located between the heat exchanger and the heat source to direct coolant from the heat exchanger to the heat source;

a valve located between the heat source and the heat exchanger, the valve being movable to vary a rate of coolant flow through the heat exchanger and around the heat exchanger to the coolant pump;

a sensor located at an inlet of the heat source to generate a signal indicative of coolant temperature at the inlet;

a memory storing software adapted to execute a plurality of different operating modes; and a controller in communication with the heat source, the valve, the sensor and the memory, the controller being configured to detect an operational status of the heat source, the controller being configured to operate the cooling system in a shutdown mode in response to determining that the operational status of the heat source changes from a on status to an off status, wherein the shutdown mode includes a first shutdown mode corresponding with a delayed cool down of the heat source, and the controller is configured to move the valve to pass a majority of coolant around the heat exchanger to the coolant pump during the first shutdown mode, and wherein the shutdown mode includes a second shutdown mode corresponding with a rapid cool down of the heat source, and the controller is configured to move the valve to pass a majority of coolant through the heat exchanger to the coolant pump during the shutdown mode.

13. The cooling system of claim 12, wherein the first and second shutdown modes are operator selectable.

* * * * *